US005940911A

United States Patent [19]

Wang

[11] Patent Number: 5,940,911

[45] Date of Patent: Aug. 24, 1999

[54] MULTI-FUNCTIONAL BED STRUCTURE

[76] Inventor: Yi-Lung Wang, No. 34-2, Lane 166, An Lo Road, Sec. 2, Chidu, Keelung, Taiwan

[21] Appl. No.: 08/967,025

[22] Filed: Nov. 10, 1997

[51] Int. Cl.[6] ..... A61G 7/005

[52] U.S. Cl. ..... 5/610; 5/600; 5/611; 5/147

[58] Field of Search ..... 5/600, 607, 610, 5/611, 147

[56] References Cited

U.S. PATENT DOCUMENTS

| | | | |
|---|---|---|---|
| 3,336,606 | 8/1967 | Beitzel | 5/610 |
| 3,517,397 | 6/1970 | Moore | 5/147 |
| 3,703,735 | 11/1972 | Moore | 5/147 |
| 4,103,373 | 8/1978 | Luedtke et al. | 5/147 X |
| 4,534,076 | 8/1985 | Barge | 5/147 |
| 4,960,271 | 10/1990 | Sebring | 5/611 X |

*Primary Examiner*—Michael F. Trettel

*Attorney, Agent, or Firm*—Dougherty & Troxell

[57] ABSTRACT

Disclosed is a multi-functional bed structure which includes a main operational control unit and a bed portion. The main operational control unit includes an elevating mechanism which can be controlled to cause the bed portion to move up and down or forward and backward reciprocatingly in different selected manners. The bed portion may be a roller type or a non-roller type. A roller type bed portion includes a chassis structure below a mattress-supporting bed frame provided with roller rails. A lifting mechanism is mounted on the chassis structure to lift or lower the bed frame by engaging rollers connected to a top of the lifting mechanism with the roller rails on the bed frame. A raising mechanism is mounted below the bed frame to raise different parts of the mattress as needed by the user. The elevating, the lifting, and the raising mechanisms all can be operated in three different control manners, namely, manual, displacement range, and random controls, so that the bed portion may be shifted rhythmically.

18 Claims, 13 Drawing Sheets

MULTI-FUNCTIONAL BED STRUCTURE

BACKGROUND OF THE INVENTION

The present invention relates to a multi-functional bed structure including a bed portion which can be moved in different manner via a transmission mechanism driven by an electric or hydraulic motor while the motor can be conveniently controlled with a controller.

Most conventional beds for leisure purposes usually have a fixed bed frame which cannot be freely moved upward and downward or inclined. Only a mattress can be angularly raised at a head and/or a rear portion by means of an electrically controlled raising mechanism mounted below the bed frame, or be vibrated by means of a electric vibrator mounted inside the mattress to achieve a massage effect.

SUMMARY OF THE INVENTION

A primary object of the present invention is to provide a bed structure in which the bed mattress can have a structure similar to that of a conventional bed structure and the bed frame can be moved up and down or forward or backward in a regular or an irregular manner through an elevating mechanism mounted to a head end of the bed and a lifting mechanism mounted to a rear end of the bed. Such bed structure can be used for physical rehabilitation or general leisure purposes.

To achieve the above object, the bed structure of the present invention is provided with a main operational control unit and a controller for controlling operating parameters of a motor in the main operational control unit. The operating parameters include the speed, the displacement, and the reverse pause time of the motor. These parameters may be grouped into different combinations for a user to select via the controller. The user may select to automatically move the bed frame in one or more of the parameter combinations in a regular manner, to automatically move the bed frame in one or more of the parameter combinations in an irregular or random manner, or to manually inch or stop the bed frame at any time in any parameter combination. The main operational control unit includes a transmission mechanism to move the bed frame in response to the controller. The transmission mechanism includes a motor which operates to rotate a transmission shaft so as to drive two chains connected thereto to cause two elevating heads on the chains to move up and down. The bed frame is connected at a head end to the elevating heads and can therefore move along with the elevating heads.

The bed according to the present invention can have two different structures, namely, non-roller type and roller type.

The non-roller type bed structure includes a mattress consisting of four parts, a bed frame supporting the mattress, a folding leg frame provided below the bed frame near a head end of the bed, a fixed leg frame connected to a rear end of the bed. The bed is provided with a conventional mattress raising mechanism to raise a head part and a rear part of the mattress to adjustably incline them at a desired angle relative to the bed frame. Both the folding and the fixed leg frames have casters mounted to a bottom end thereof. When the folding leg frame is in a folded position, the bed connected at a head end to the elevating heads can slide forward or backward while the elevating heads move downward or upward. The whole bed can also be separated from the main operational control unit for use as an independent bed.

The roller type bed structure includes a mattress similar to that of the non-roller type bed, a bed frame supporting the mattress and having a head end connected to the elevating heads of the main operational control unit, a chassis structure including two side beams firmly locked to a base of the main operational control unit, and a lifting mechanism connected to rear ends of the side beams for adjusting an inclined angle of the bed frame. The bed frame is movably located above the chassis structure and is provided along its two side members with two roller channels. Two rollers connected to two ends of a roller shaft on a top of the lifting mechanism are separately set in the roller channels to slide therein. The lifting mechanism further includes an extensible rod, a spring, two side supporting arms, and a transverse shaft. When the extensible rod is driven by an oil cylinder or motor to push or pull the transverse shaft, the roller shaft and the rollers are brought to slide along the roller channels on the side members of the bed frame and thereby pivotally lifts or lowers a rear end of the bed frame. A plurality of casters are mounted below the chassis structure for convenient moving of the whole bed structure.

The above structure is suitable for both single and double beds. Lighting fixtures, stereo, article compartment, safe, etc. can be located at proper positions near the main operational control unit. A remote controller can be used to manually, automatically, and randomly control the movement of the motor and accordingly the bed. Following are the functions which can be achieved through the bed structure of the present invention:

1. The bed may be adjusted to have a downward inclined head portion so as to help a patient suffering from lung disease to cough out cumulated sputa when the patient lies prone with feet secured by safety loops and an attendant lightly pats the patient's back.

2. The bed may be adjusted to have a downward inclined head portion so that a patient may lie on the bed with his head pointing down when necessary.

3. The bed may be adjusted to different heights and/or inclinations depending on a user's need.

4. The bed may be adjusted to have a slightly arched middle portion, so that the user's waist and spine can be properly supported.

5. The bed may be regularly and rhythmically moved up and down at suitable speed, displacement, and reverse pause time like a cradle to help the user to fall asleep.

6. The bed may be irregularly and randomly moved up and down following musical beats to create leisure entertainment.

7. The bed may be provided with a timer so that the bed stops moving or starts vibrating at a predetermined time.

8. The bed may be provided with rails and an infusion rack to serve as a multi-functional sickbed.

DETAILED DESCRIPTION OF THE PREFERRED EMBODIMENTS

Figure 1:
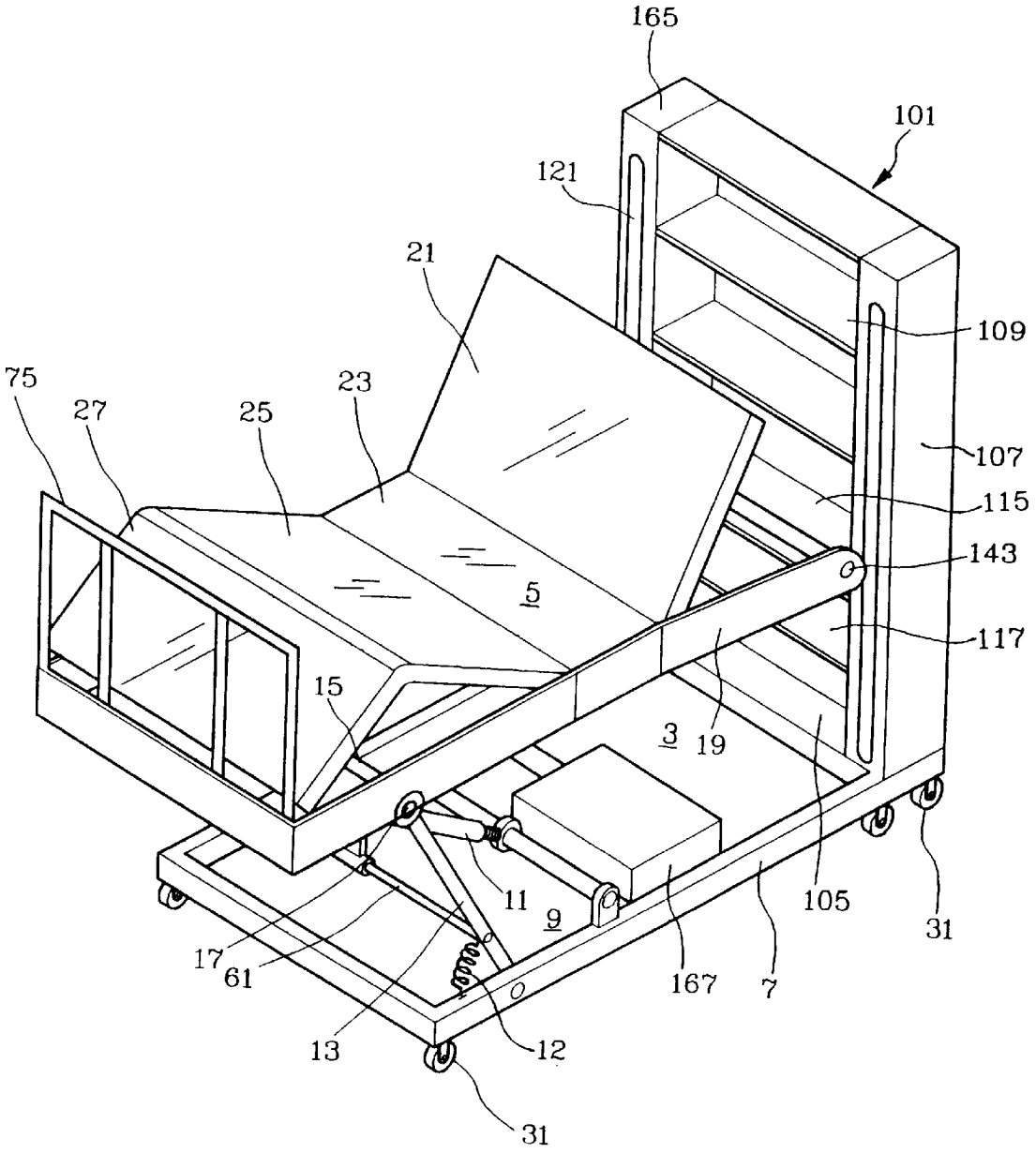
FIG. 1 is an assembled perspective of a roller-contained type bed according to the present invention.

Please refer to FIGS. 1 to 4 for the main parts included in the bed structure of the present invention.

The bed structure mainly includes a main operational control unit 101 which includes a bed head housing 165, a base 105, two upstanding side frames 107, and a middle space 109 defined by the housing 165, the base 105, and the side frames 107. The middle space 109 is divided from top to bottom into several compartments for mounting a lighting fixture 111, a stereo 113, an article compartment 115, and a safe 117. Each side frame 107 is provided at a front surface with a centered elongated opening 121 to serve as a rail along which an elevating head 143 moves.

Figure 3:
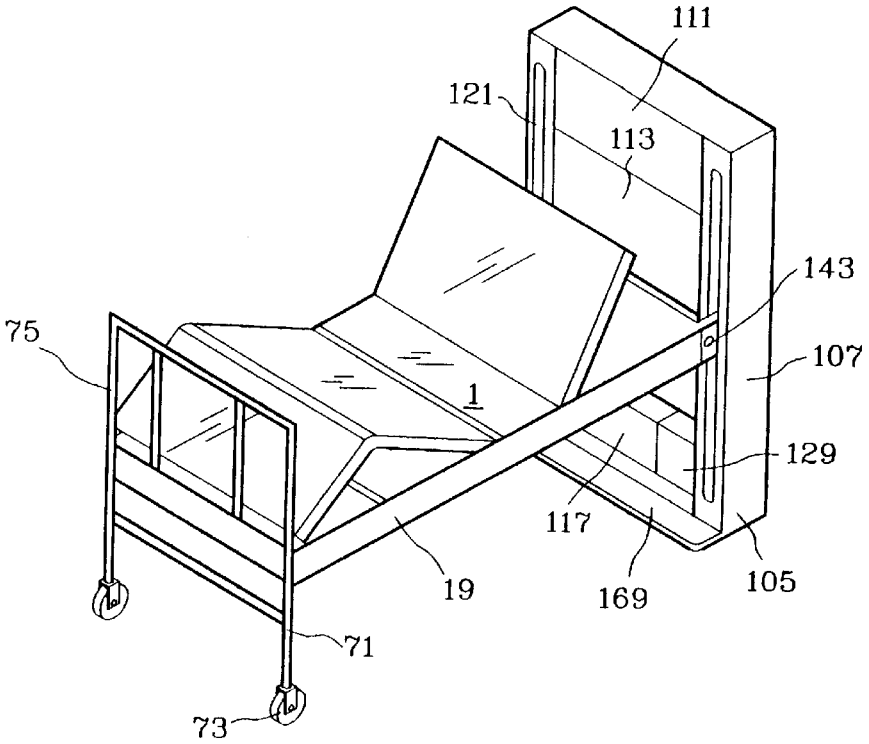
FIG. 3 is an assembled perspective of a non-roller type bed according to the present invention.
Figure 4:
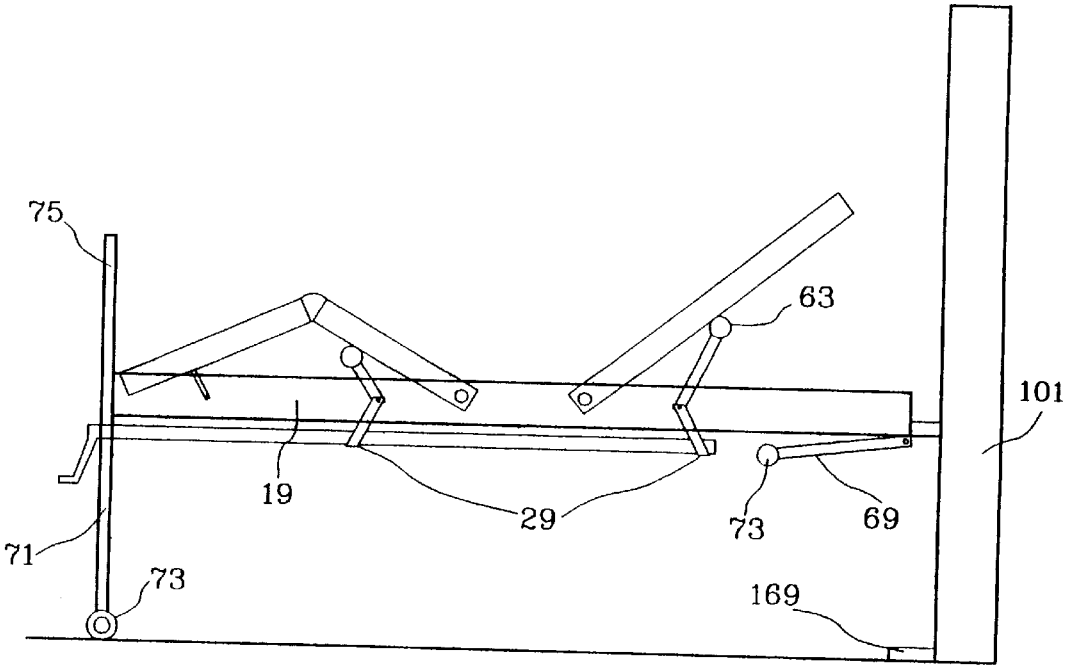
FIG. 4 is a side view of the non-roller type bed of FIG. 3.

There are two types of bed 1 may be selectively connected to the elevating heads 143 associated with the main operational control unit 101, namely:

1. A non-roller bed as shown in FIGS. 3 and 4. This type of bed 1 includes a mattress consisting of four parts 21, 23, 25 and 27, a bed frame 19 supporting the mattress, a folding leg frame 69 provided below the bed frame 19 near a head end of the bed 1, and a fixed leg frame 71 connected to a rear end of the bed 1. The four parts of the mattress are a movable back rest part 21, a fixed hip rest part 23, a movable thigh rest part 25, and a movable leg rest part 27. The bed frame 19 may be a right-angled or a slightly rounded-angled frame associated with the four parts of the mattress. The bed 1 is provided with a conventional mattress raising mechanism 29 to raise a head end of the back rest part 21 so that the latter is adjustably inclined at an angle relative to the bed frame 19. Moreover, the raising mechanism 29 also permits a joint between the thigh rest part 25 and the leg rest part 27 to arch. Both the folding and the fixed leg frames 69, 71 have casters 73 mounted to a bottom end thereof. When the folding leg frame 69 is in folded position, the bed 1 connected at a head end to the elevating heads 143 slide forward or backward while the elevating heads 143 move downward or upward.

Figure 2:
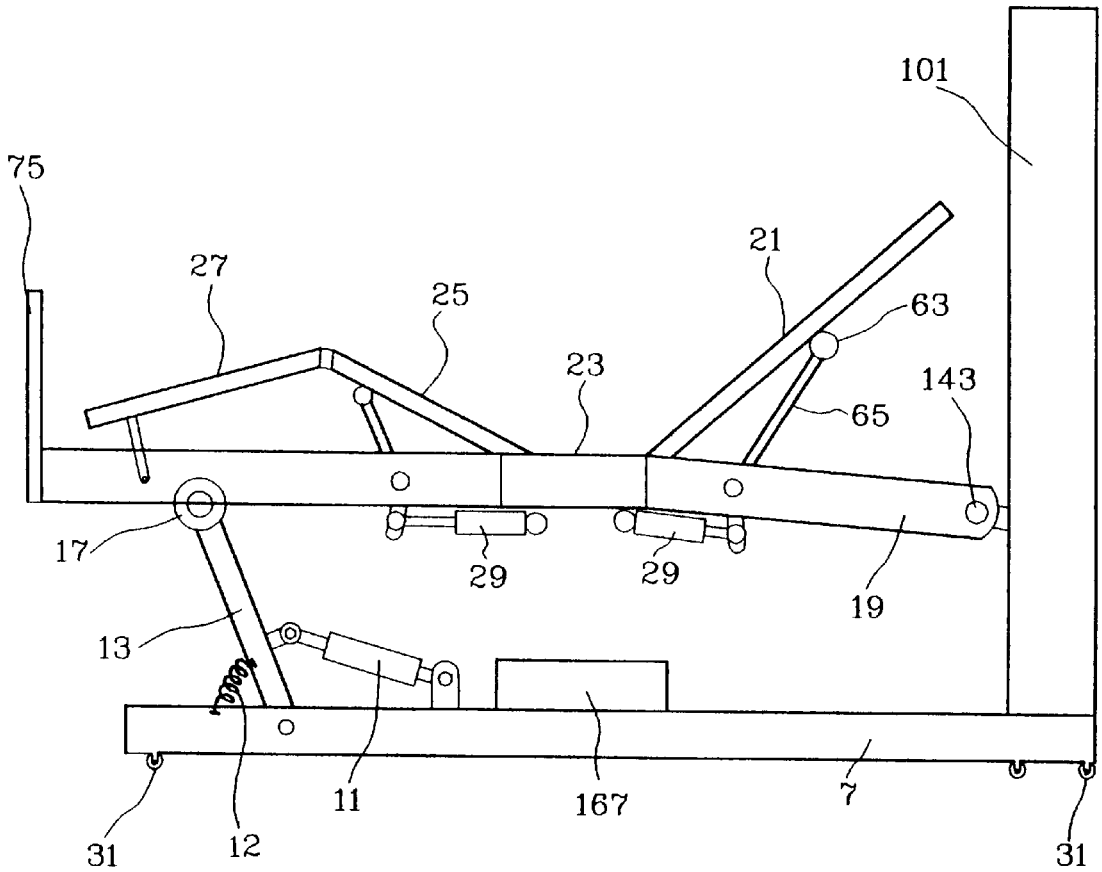
FIG. 2 is a side view of the roller-contained type bed of FIG. 1.

2. A roller bed as shown in FIGS. 1 and 2. This type of bed 1 includes a mattress 5 consisting of four parts 21, 23, 25 and 27, a bed frame 19 supporting the mattress and having a head end connected to the elevating heads 143 of the main operational control unit 101, a chassis structure 3 including two side beams 7 firmly locked to the base 105 of the main operational control unit 101, and a lifting mechanism 9 connected to rear ends of the side beams 7 for adjusting an inclined angle of the bed frame 19 relative to the bed head housing 165. The mattress 5 has similar structure as that of the mattress in the non-roller type bed 1. The bed frame 19 is movably located above the chassis structure 3 and is provided along its two side members with two roller channels. Two rollers 17 connected to two ends of a roller shaft 15 are separately set in the roller channels to slide therein. The lifting mechanism 9 further includes an extensible rod 11, a spring 12, two side supporting arms 13, and a transverse shaft 61. The extensible rod 11 is so mounted that two ends thereof are pivotally turnable. The side supporting arms 13 are separately connected at their upper ends to two outer ends of the roller shaft 15. When the extensible rod 11 is driven by an oil cylinder or motor to push or pull the transverse shaft 61 connected to and extending between lower portions of the two side supporting arms 13, the roller shaft 15 and the rollers 17 are caused to slide along the roller channels on the side members of the bed frame 19 and thereby lifting or lowering a rear end of the bed frame 19 relative to the chassis structure 3. A plurality of casters 31 are provided for convenient moving of the whole bed structure.

Figure 5A:
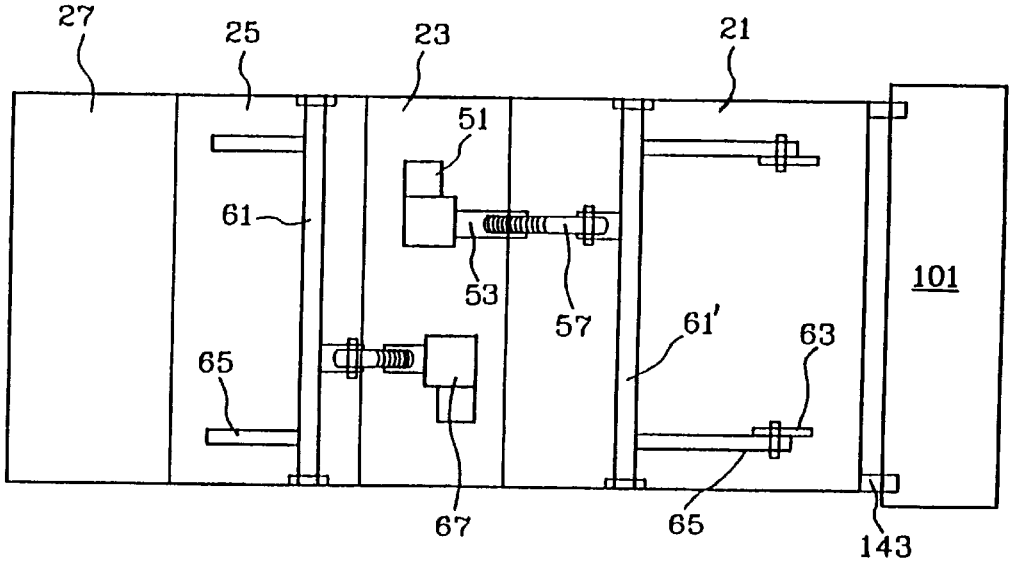
FIG. 5A is a bottom view of the bed according to the present invention.
Figure 5B:
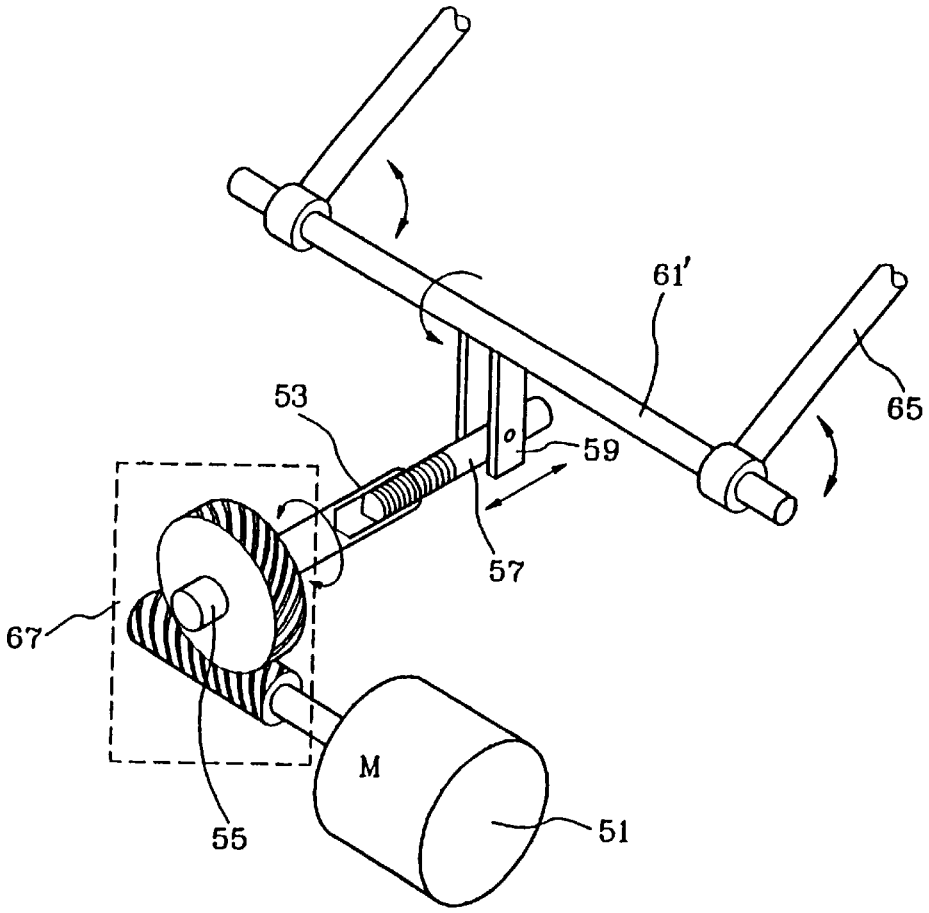
FIG. 5B is an enlarged perspective of a raising mechanism adopted in the bed of the present invention.

Please refer to FIGS. 5A and 5B which are bottom plan view of the bed 1 and enlarged perspective view of a raising mechanism 29, respectively, of the present invention. Two raising mechanisms 29 are provided below the bed frame 19 of the bed 1 and each includes a motor 51 which drives a reduction gear box 67 to rotate a rotating shaft 55 which has one end connected to a gear inside the reduction gear box 67 and another end formed with an internally threaded sleeve 53. A shifting thread rod 57 is engaged into the threaded sleeve 53. When the rotating shaft 55 is rotated by the reduction gear box 67, it in turn forces the shifting thread rod 57 in the threaded sleeve 53 to push or pull links 59 connected to and extending between the thread rod 57 and a transverse shaft 61', so that the transverse shaft 61' is turned to bring two raising arms 65 firmly welded to two ends of the transverse shaft 61' to push and raise or pull and lower the back rest, the thigh rest, and the leg rest parts of the mattress and adjust their inclined angles relative to the bed frame 19. A supporting roller 63 is connected to another end of each raising arm 65 to slidably contact with the parts of the mattress.

The extensible rod 11 of the lifting mechanism 9 is also driven by an oil cylinder or motor to pull up or push down the transverse shaft 61 extending between the two side supporting arms 13 in the same manner as that found in the raising mechanism 29.

In the main operational control unit 101, there is provided a transmission mechanism. This transmission mechanism may have different structures to match the two different types of bed 1 provided by the present invention.

Figure 6:
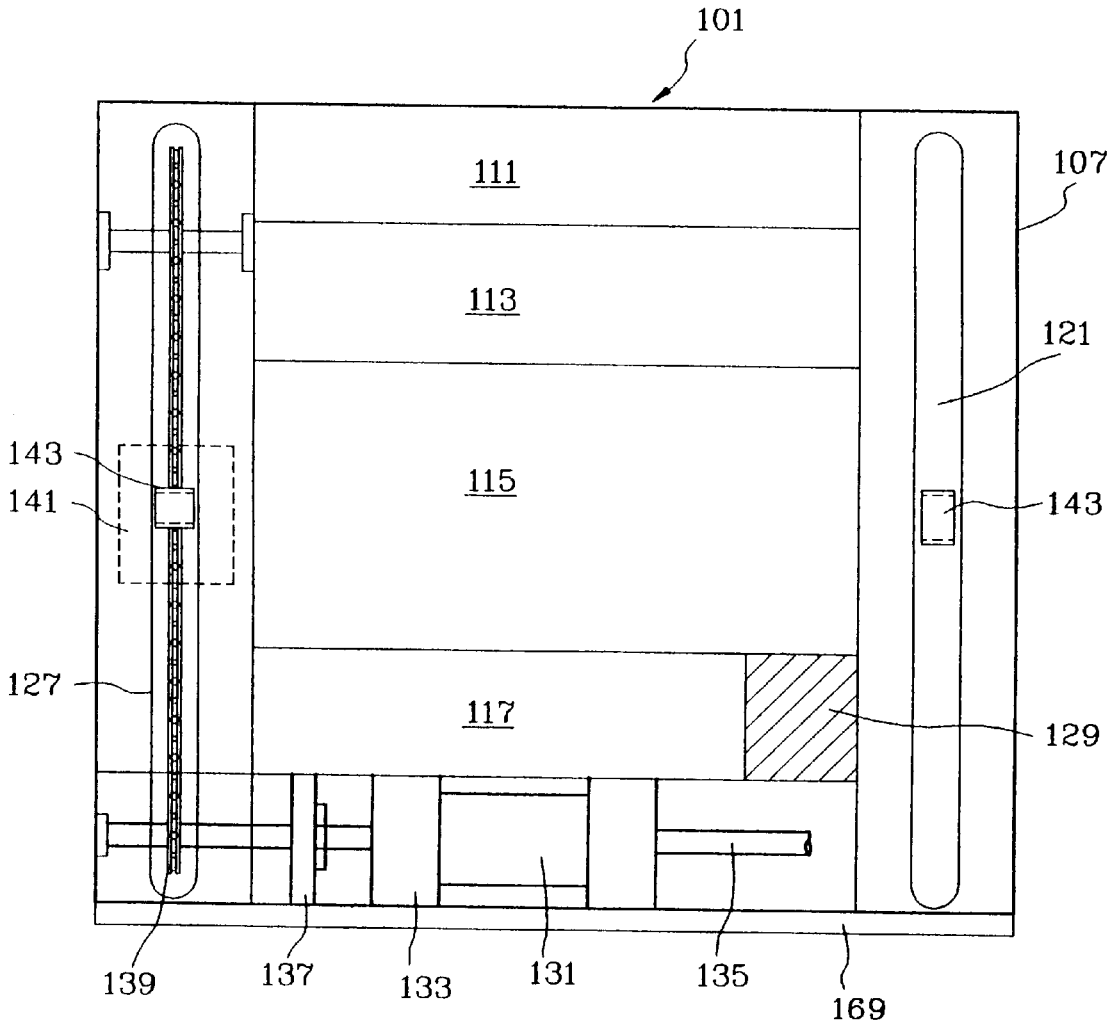
FIG. 6 illustrates arrangements inside the bed head housing of the present invention.

As shown in FIG. 6, the transmission mechanism of the main operational control unit 101 includes an elevating mechanism 127 which further includes a controller 129 generally disposed in the lowest compartment 117 of the space 109, an electric or oil cylinder-driven motor 131, a gearbox 133, a transmission shaft 135, an electromagnetic brake 137 mounted in the base 105, two chains 139 separately disposed in the two side frames 107, two weights 141 separately connected to rear ends of the chains 139, and the elevating heads 143 separately connected to front ends of the chains 139.

Figure 7:
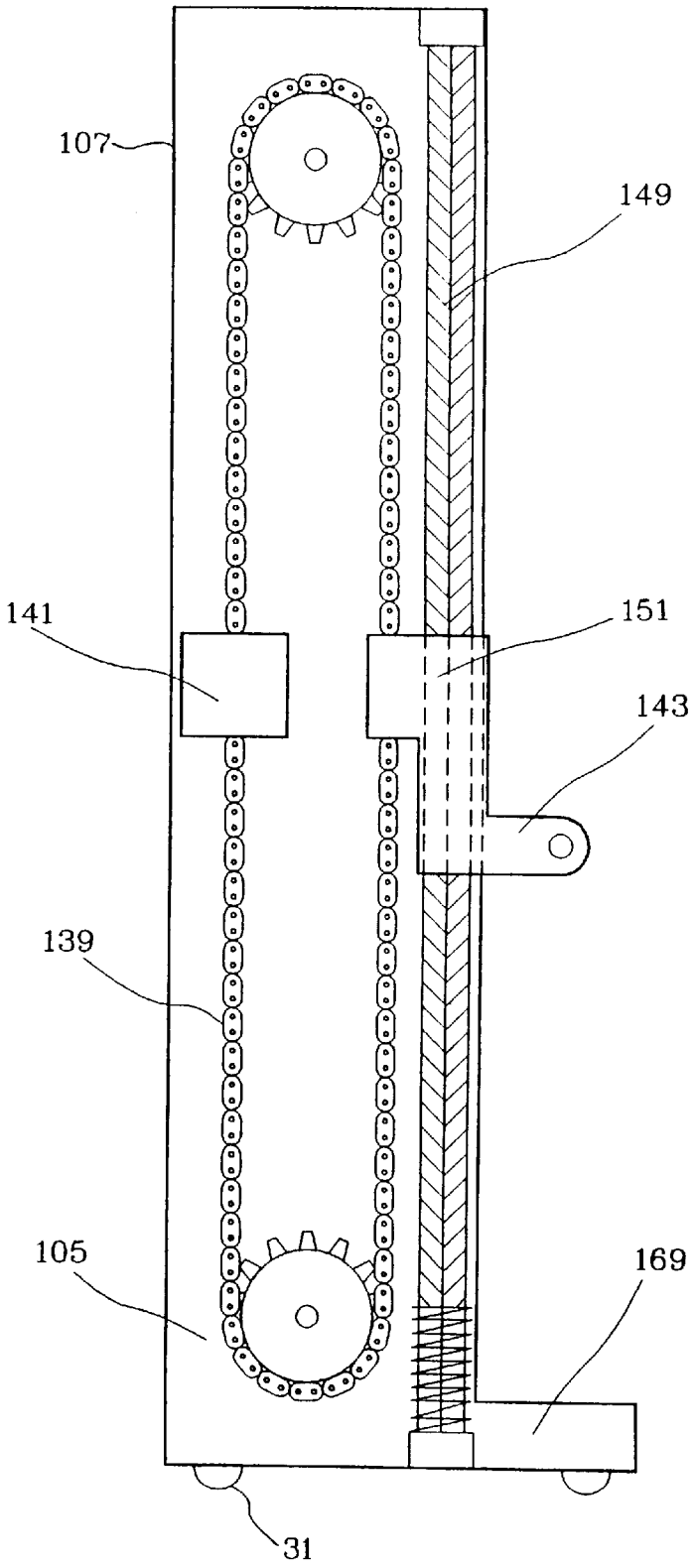
FIG. 7 is a side sectional view of the transmission mechanism for the linear guide rail of the present invention.

Please refer to FIG. 7. The motor 131 operates to rotate the transmission shaft 135 via the gearbox 133. The rotating transmission shaft 135 causes the chains 139 in two side frames 107 to move in a closed path. Each rotating chain 139 causes a rail sleeve 151 to travel up and down along a linear guide rail 149 in the side frame 107. The weights 141 are separately connected to rear ends of the chains 139, so as to balance loads on the elevating heads 143 on a front end of the rail sleeve 151.

Figure 8:
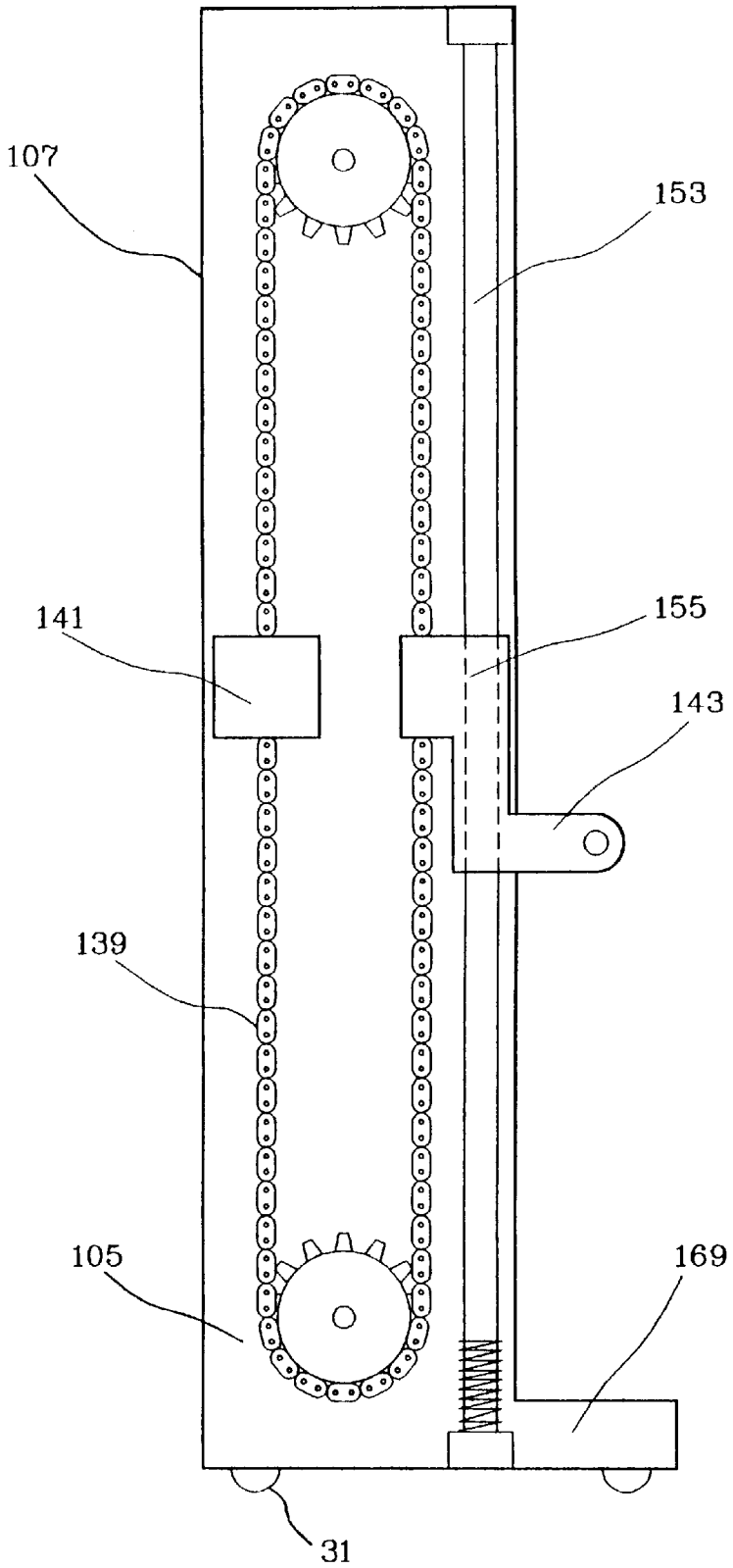
FIG. 8 is a side sectional view of the transmission mechanism for the linear guide rod of the present invention.

FIG. 8 shows a chain system similar to that of FIG. 7 but the linear guide rail 149 is replaced with a linear guide rod 153. A guide rod sleeve 155 is connected to a front end of the chain 139 and is caused by the chain 139 to travel up and down along the guide rod 153. Again, a weight 141 is connected to a rear end of the chain 139.

Figure 9:
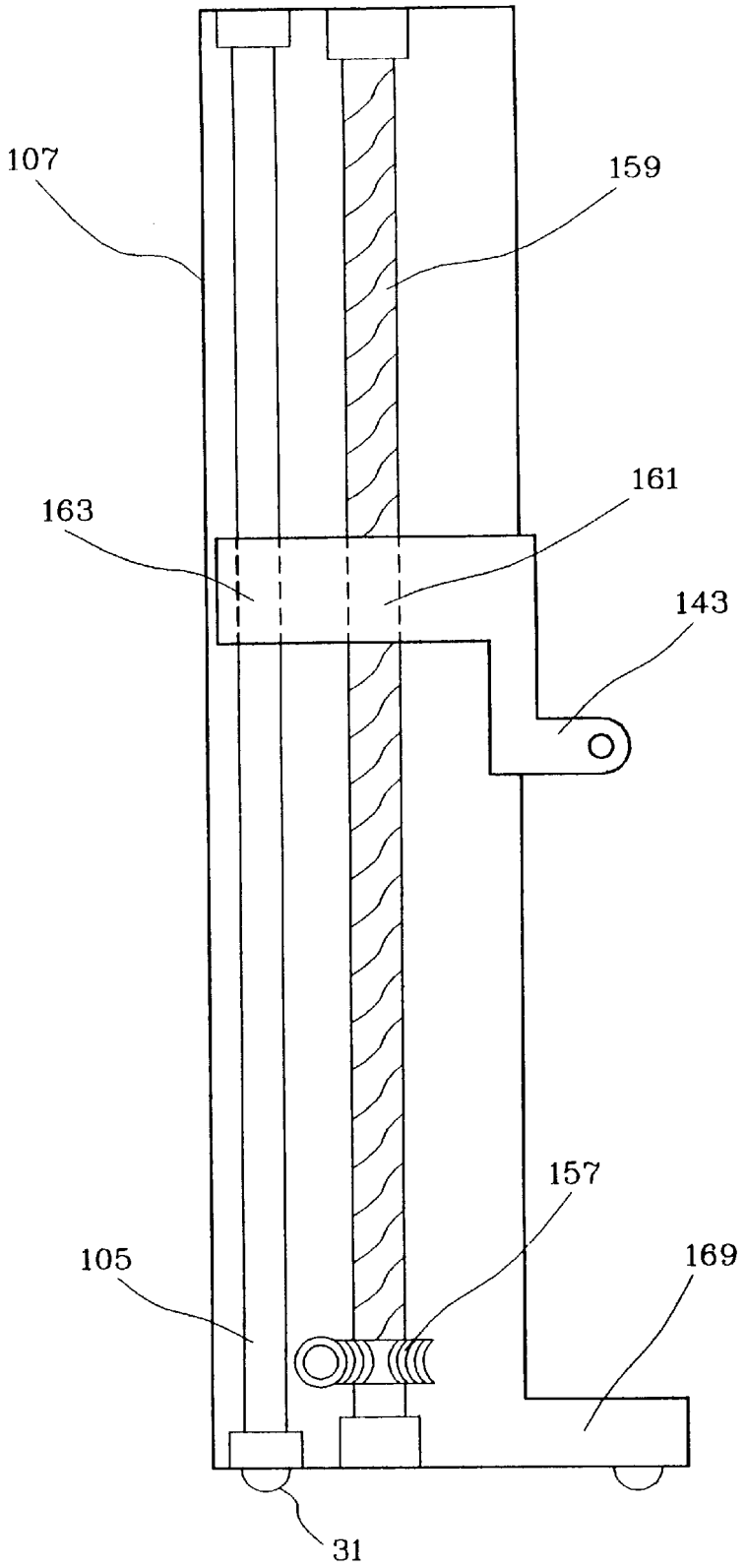
FIG. 9 is a side sectional view of the transmission mechanism for the ball thread rod of the present invention.

Please refer to FIG. 9 in which a further embodiment of the elevating mechanism 127 of the main operational control unit 101 is shown. The gearbox 133 drives worm gears 157 provided in each of the two side frames 107, so as to rotate two upright ball thread rods 159 also provided in the side frames 107. Each of the ball thread rods 159 has a movable ball thread rod sleeve 161 associated therewith. The sleeve 161 is connected at a rear end to a linear guide rod 163 in the side frame 107, so that the transmission mechanism may stop at a fixed position at any time without using the electromagnetic brake 137.

The chains 139 may also be replaced by racks, belts, etc.

Figure 10:
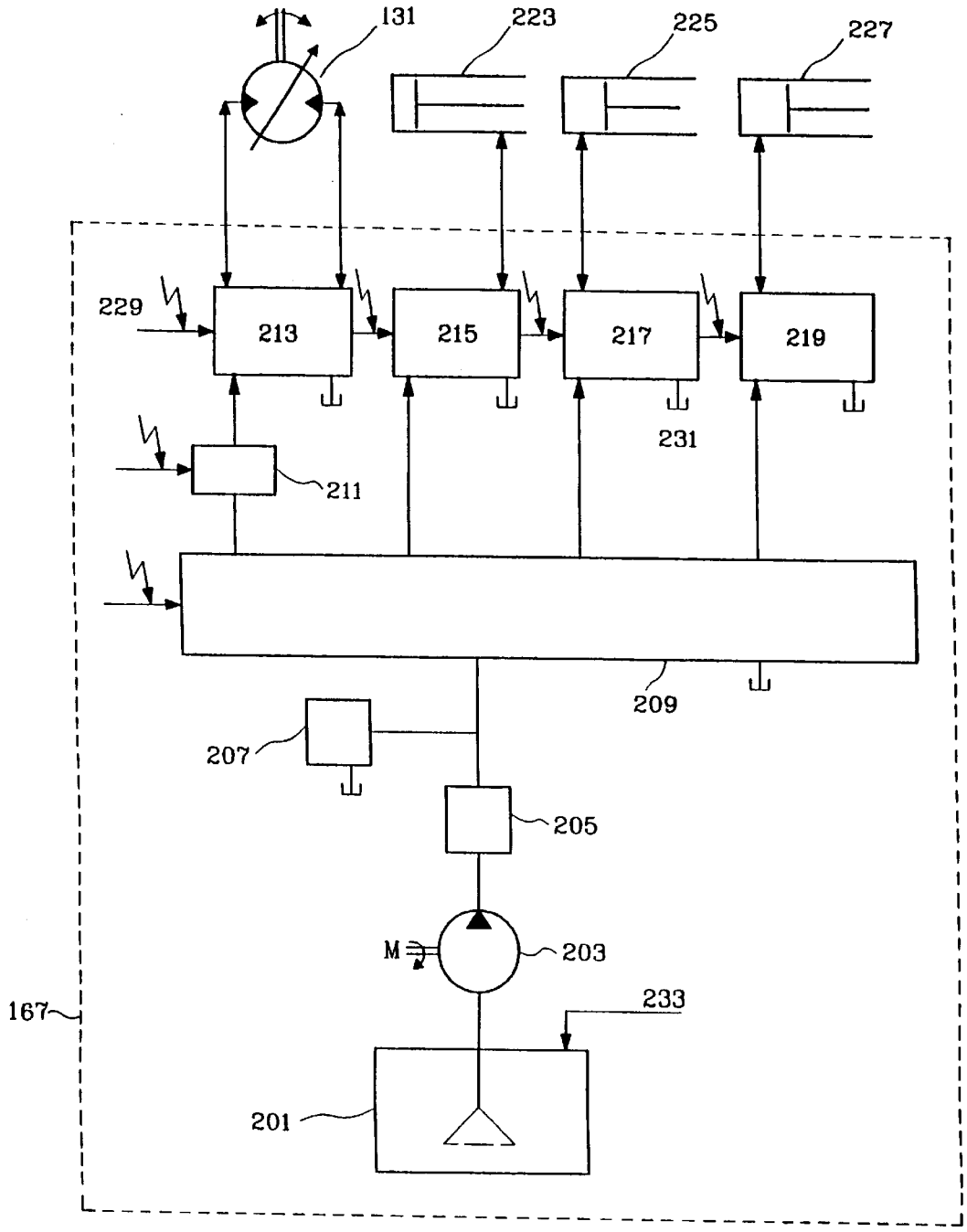
FIG. 10 is a block diagram showing the hydraulic power system of the bed according to the present invention.

FIG. 10 is a block diagram of a hydraulic power system 167 adopted by the present invention. Wherein, in addition to the electric motor 131 of the main operational control unit 101, there is an oil tank and filter unit 201, a hydraulic pump 203, a check valve 205, a hydraulic adjusting valve 207, electromagnetic signals 229 input by a main is controller, an electromagnetically controlled main circuit oil valve 209, an electromagnetically controlled speed-adjustable flow control valve 211, a hydraulic motor electromagnetically controlled speed-reducible inverter valve 213, an electromagnetically controlled inverter valve 215 for the lifting mechanism, an electromagnetically controlled inverter valve 217 for the back rest part raising mechanism, an electromagnetically controlled inverter valve 219 for the leg rest part raising mechanism, oil 231 for all shunts, and oil 233 for all main circuits. This hydraulic power system 167 drives a lifting mechanism oil cylinder 223, a back rest part raising mechanism oil cylinder 225, a leg part raising mechanism oil cylinder 227, or the hydraulic motor 131.

Figure 11:
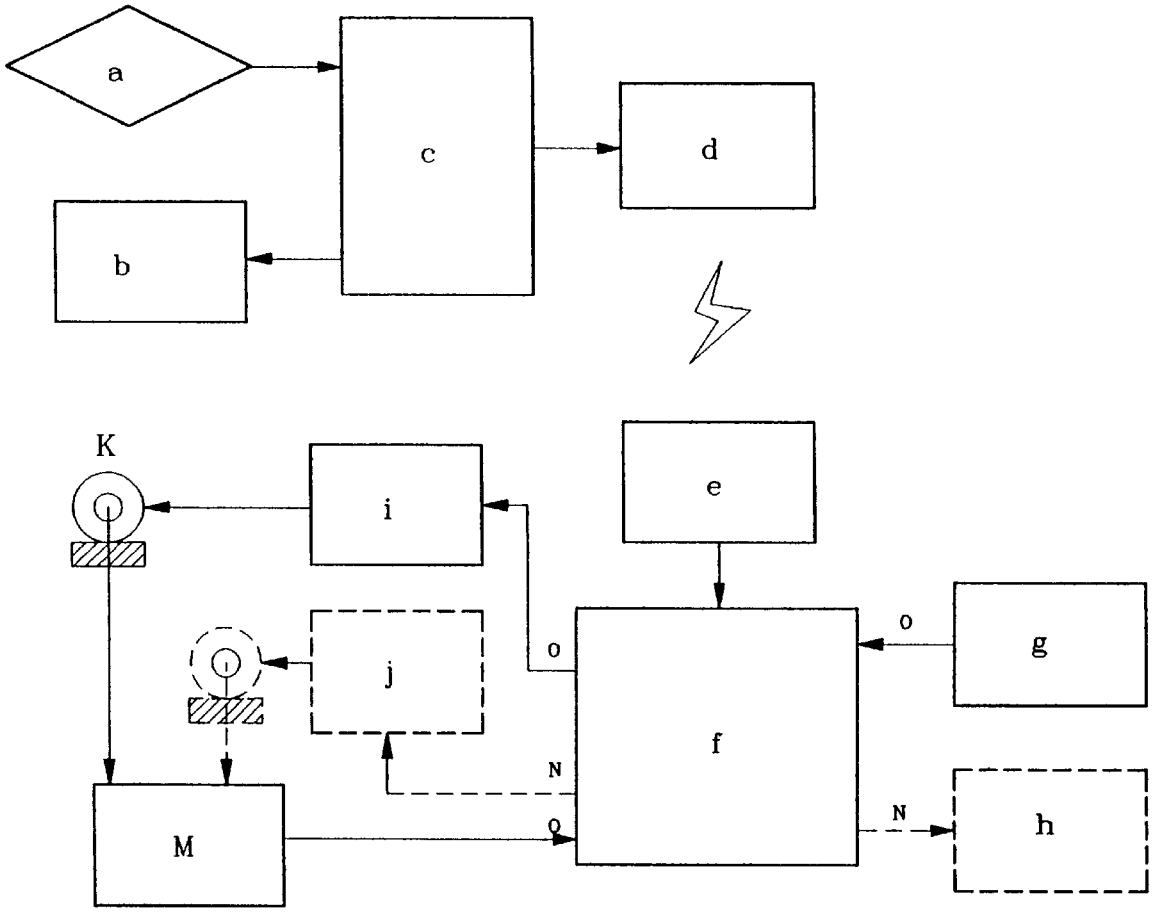
FIG. 11 is a block diagram showing the control of the bed according to the present invention.

FIG. 11 is a block diagram showing the detailed structure of the controller 129 for the bed structure of the present invention. In the diagram, letter "a" stands for a changing function setting swtich, "b" for a display, "c" for a remote controller, "d" for an emitter, "e" for a receiver, "f" for a main controller, "g" for a stereo, "h" for a sound control, "i" for a hydraulic motor driver, "j" for an electric motor driver, "k" for a hydraulic motor, "l" for an electric motor, "m" for a displacement monitor, "n" for an outpur signal O, and "o" for an input signal I. Wherein, the main controller "f" further includes a power source, a CPU, a ROM (an internally operating program), a RAM, a receiver input interface, a stereo input interface, a displacement monitor input interface, a sound control output interface, a motor driver output interface, and a connecting BUS.

Following is a description of the manner in which the controller 129 functions.

When the bed structure of the present invention is remotely controlled, a programmable controller or a microcomputer controller with such functions as, such as memorizing, computing, sequence setting, time setting, random access, etc., cooperates with the I/O devices to actuate the motor driver to control parameters, such as motor rotating speed "v", displacement "d", and reverse pause time "t", so that different combinations of these parameters can be grouped to meet different needs in controlling the bed of the present invention. However, to ensure the above control system is used in a safe, reliable and durable manner, the following design specification is recommended:

$$\frac{d \times t}{v} = \frac{c}{f}$$

wherein, d=displacement, t=reverse pause time,

V=speed, c=limitation constant, f=frequency of use.

Limitation constant "c" is a sum of a given usable life and working range of the equipment (that is, the bed). The length of operating time and the frequency of use of the bed must also take into consideration. If a quick motor speed "v" is required, the displacement "d" or the reverse pause time "t" must be longer.

Figure 12:
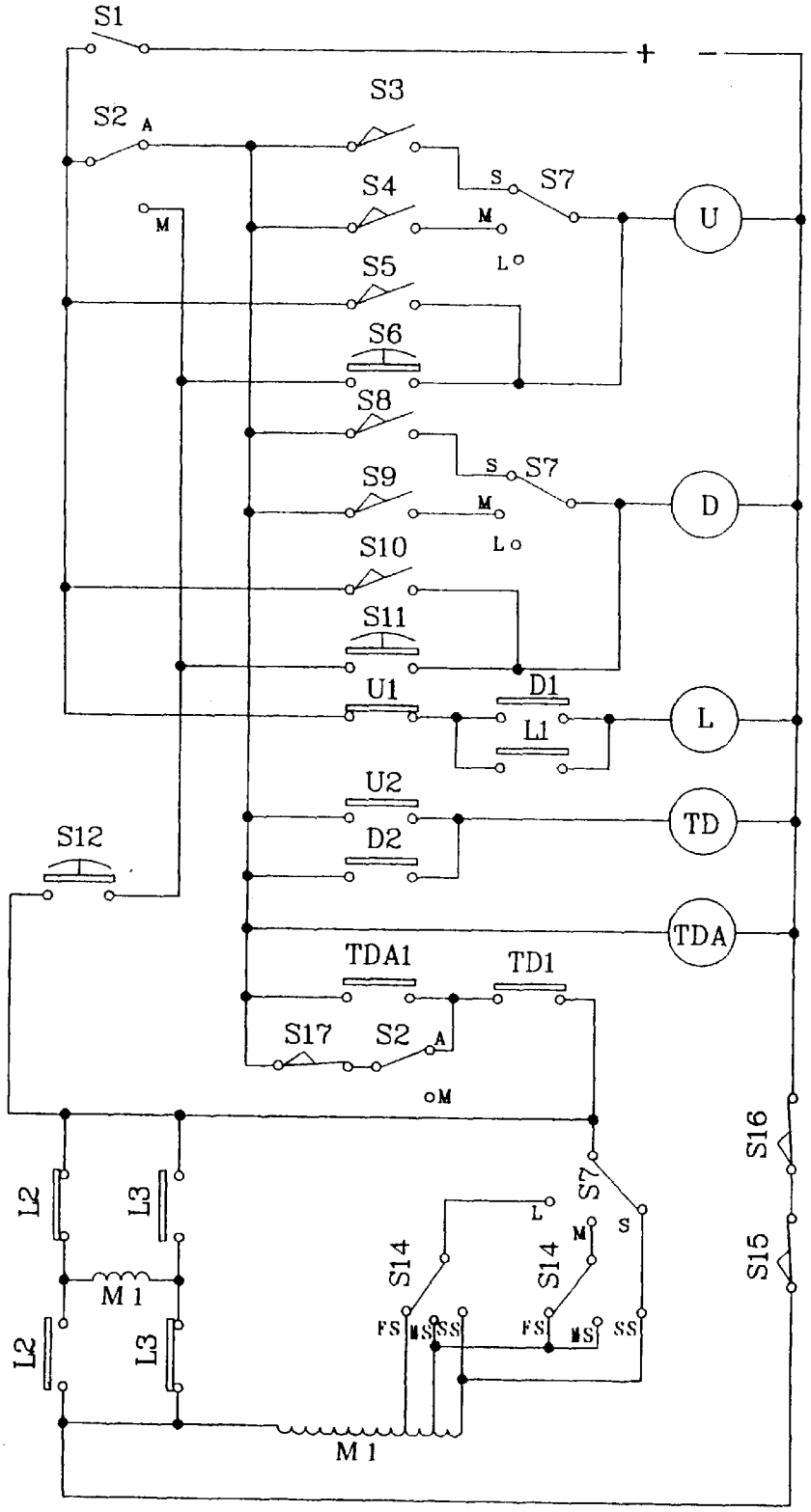
FIG. 12 is a basic control circuit diagram of the present invention.

FIG. 12 is a diagram of a basic control circuit adopted to control the bed of the present invention, wherein

S1=Power switch

S2=In operation, (a) a Manual/Automatic selector switch and (b) a Manual/free middle position switch work at the same time.

S3, S4, S5=Up limit switches

S6=Set "down manually"

S7=In operation, (a) an Up selector switch, (b) a Down selector switch, and (c) a limited displacing speed selector switch work at the same time.

S8, S9, S10=Down limit switches

S11=Set "up manually"

S12=Inching switch

S14=Speed selector switch

S15, S16=High and Low limit switches

S17=Middle displacement switch

U=Up switch relay

D=Down switch relay

L=Motor reverse relay

TD=Motor reverse pause time relay

TDA=Time switch

L1=L magnetizing self-protecting switch

M1=Motor coil

Following is a brief description of movements included in the operation of the bed of the present invention.

A. For manual operations:

S2 is switched to "M". Depress S6 to select "Down", or depress S11 to select "Up". Switch S14 to a set speed. Depress S12 to displace inch by inch until S5 or S10 is touched to displace in a reverse direction.

B. For automatic operations:

S2 is switched to "A" and the bed automatically stops at a middle position. Switch S7 to set the travel. Switch S14 to set speed. Switch TD to set pause time. Adjust TDA to set operating time. An automatic operation of the bed starts until the set operating time is reached. The bed will then automatically stop at a middle position.

About the controller, when a factor of manufacturing cost is taken into consideration, it can be differently designed to achieve one of the following three control parameters.

1. Simple control:

To achieve the simple control, only Up limit swtiches, Down limit switches, several pairs of fixed induction switches for selecting stage control, and a conventional three-stage speed control mechanism are required to provide a manual or regular movement during the displacement of the bed frame.

2. Accurate control:

An accurate control further includes:

a. Provision of Up and Down limit switches as well as Return-to-zero induction switches (for returning the bed frame to a horizontal position) to control the displacement of the elevating mechanism in the two side frames 107 of the main operational control unit.

b. Manual control. That is, after a desired speed is set and the remote controller is aimed toward the bed, the depression of a right push button starts the elevating mechanism and the release of the push button stops the elevating mechanism. And, when the Up and the Down limit switches are touched, the elevating mechanism immediately stops and returns to zero before it can start again.

c. Displacement range control. That is, when the bed is returned to zero (in a horizontal position), the elevating heads 143 are driven through manual operation to move up or down to a desired position and a button Ml standing for a memorized start is depressed. The elevating heads 143 are moved up or down again for a desired distance and a button M2 standing for a memorized end is depressed. A counting element of the displacement monitor inputs signals converted from rotating numbers of the motor 131 to the memory of the controller to memorize the displacement "d" from the start Ml to the end M2. After the desired speed "v", the desired reverse pause time "t", and the operating time are set, a Start button is depressed. The elevating heads 143 will regularly move up and down reciprocatingly within the memorized range of displacement "d" (M1←→M2) at the set speed "v" and according to the set reverse pause time "t", until the time setting is cleared.

d. Random control. That is, many other different displacement ranges may be set and memorized based on the manually set and memorized start (M1) and end (M1), so as to develop groups of memorized displacement cycles. For example, a first group of memorized displacement cycle G1 may be G1=M1→M2→M3→M4→ . . . Mn. Whenever one cycle is completed, the elevating heads 143 automatically return to zero. Different groups of memorized displacement cycles G1, G2, G3, G4 . . . Gn may be developed. A user may freely select to repeat the same operation cycle or to depress a Random push button to randomly select different groups for the elevating mechanism 127 to operate in an irregular manner, such as G1→G5→G3→G1→G6→ . . . ), until the time setting is cleared, and the bed will return to its horizontal position.

3. Practical control.

A practical control further includes:

a. Provision of fixed Up and Down limit switches in the side frames 107 to define a displacement range, and mounting of a pair of electrically adjustable and movable Up and Down induction switches. A small motor is set to the return-to-zero (or horizontal) position. This point is used as a center to bring a rack with the induction switch mounted at an end thereof to move along a guidepost up and down symmetrically. The induction switches are used to sense magnetic codes at different points on the guidepost to determine the Up and Down positions during displacement. The switches are also used to sense the proximity of the elevating heads 143 to the switches so as to limit the range within which the elevating heads 143 can move.

b. Manual control. That is, after a desired speed is set and the remote controller is aimed to the bed, the depression of a right push button starts the elevating mechanism and the release of the push button stops the elevating mechanism. And, when the Up and the Down limit switches are touched, the elevating mechanism immediately stops.

c. Displacement range control. That is, when the induction switches are adjusted to a desired displacement range (M1→M2) and desired speed and operating time are set, depression of the Start button enables the elevating heads 143 to regularly move up and down reciprocatingly within the desired range of displacement (M1←→M2) at the desired speed until the time setting is cleared. Thus, the bed will return to a horizontal position.

d. Random control. That is, input the motor speed "v", the motor rotating seconds "d", and the reverse pause time "t" obtained and combined from experiments into the programmable controller (PLC). These parameters are grouped to provide an operating sequence, such as G=(M1→M2→M3→M4→M5→M6). More other different groups can be developed, such as G1=(M1–M6), G2=(M7–M11) . . . G18. These groups may be further divided into a high-speed group (G14, G15, G16, G17, G18), a low-speed group (G9, G10 . . . G18), and a slow-speed group (G1, G2, G3, . . . G18) according to the length of the displacement range. When different ranges are set, a proper speed group must be selected to enable the operation. A failed start indicates a selection of incorrect speed group (such as selecting a high-speed group when the displacement is short). Each of the group shall automatically return to zero when a full cycle thereof is completed. Therefore, when a maximum displacement range is desired, a push button may be depressed to select one single sequence group to either regularly circulate the operation in a manner defined by an individual speed group, or irregularly and randomly proceed the operation in a manner defined by an individual speed group or several mixed speed groups, until the time setting is cleared.

Figure 13A:
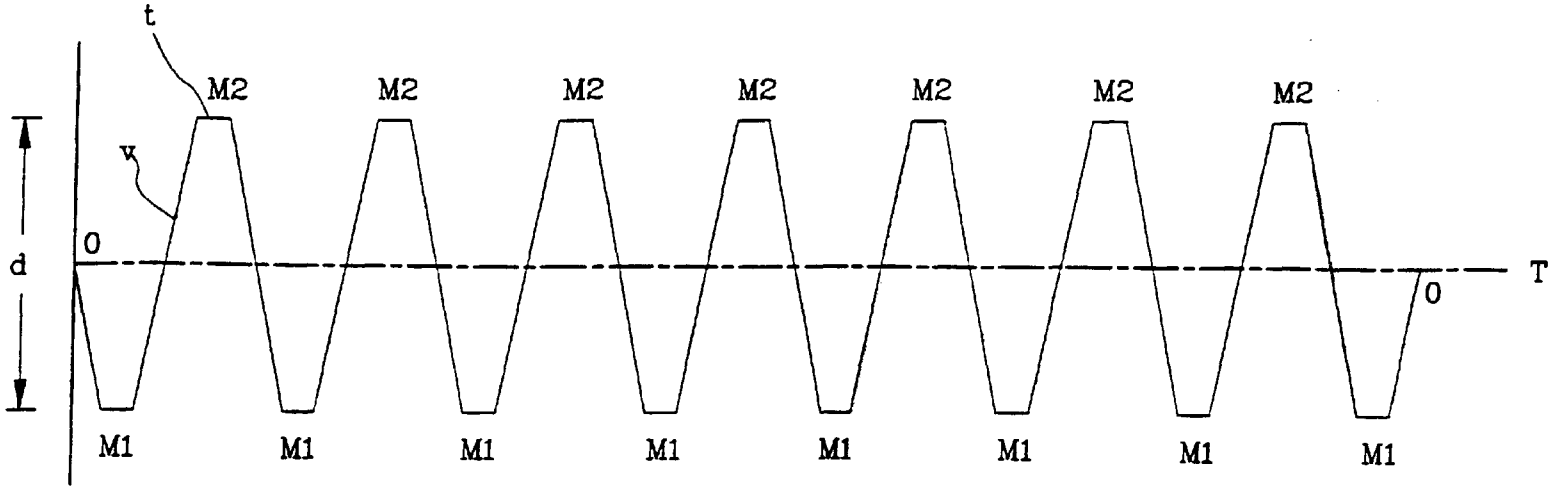
FIGS. 13A and 13B are graphs showing the wave forms representing the control manners of the present invention.
Figure 13B:
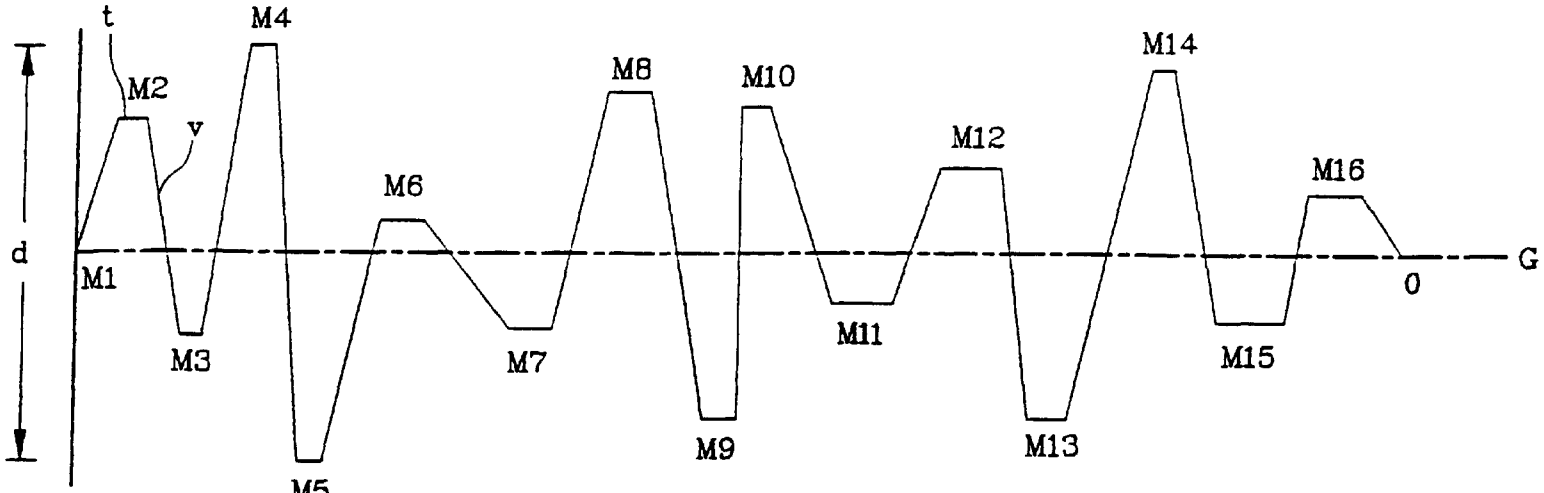
Figure 14:
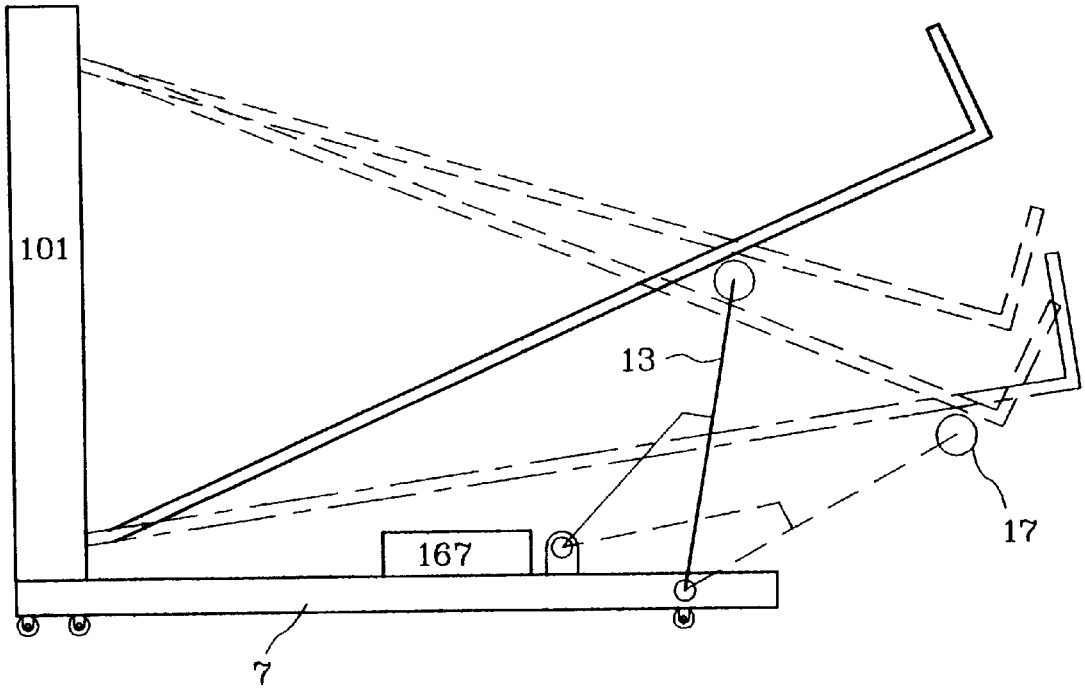
FIG. 14 illustrates different positions to which the bed of the present invention can be selectively moved.

FIGS. 13A and 13B illustrate the wave forms representing the control manner of the controller 129 adopted in the present invention. Wherein FIG. 13A is the wave form of the displacement range control, and FIG. 13B is the wave form of the random control.

There are a variety of I/O elements and circuit arrangements that may be selected for the above described controller. In application of the present invention, different controls of the up and down movements of the elevating heads 143 of the main operational control unit 101 cooperating with the simple operations of the lifting mechanism 9 and the raising mechanism 29 of the bed 1 may provide the bed of the present invention with following various kinds of functions:

1. When the raising mechanism 29 is operated to lay the back rest part 21 and the thigh rest part 25 flat, the bed 1 can be used as a common bed with a smooth surface.

2. When a desired height is set for the lifting mechanism 9, it may cooperate with the elevating heads 143 at the same height to adjust the height of the bed relative to the ground.

3. When the raising mechanism 29 is operated to make the back rest part 21, the thigh rest part 25, and the leg rest part 27 incline at different angles, the bed can be used for a user to comfortably rest his or her back and/or legs on these parts.

4. When a desired height is set for the lifting mechanism 9, it may cooperate with the elevating heads 143 at a different height to adjust the inclination of the bed relative to the ground.

5. When the raising mechanism 29 is operated to make the back rest part 21 become lower than a normally horizontal position, the bed can be adjusted to have a downwardly inclined head portion.

6. The operation of the elevating heads 143 of the main operational control unit can be differently controlled to achieve linear travel in a regular or irregular manner, causing the bed 1 to move up or down along with the elevating heads 143.

7. The bed may be controlled to move up and down following a musical rhythm. Following musical control manners are available:

a. When the manufacturing cost is not taken into consideration, a stereo 113 may be connected to the main operational control unit 101. Use an audio converter or partials producer to select from the musical rhythm low frequency signals and convert them into digital signals which are then input to the memory of the controller 129 for comparing them with previously set imitative displacement combinations, so as to select and output a matched corresponding signal. The signal is used to control the hydraulic motor 131 which has the feature of capable of shaking within a short distance and may operate in response to the musical rhythm (such as the beats of Waltz, Tango, Cha-cha) and to bring the bed 1 to move up and down or wave along with the music.

b. Alternately, a sound controller is used to quantify and combine a recorded sound of surf with operation of the bed under random control. Other music may be mixed to play at the same time to create a surrounding sound effect.

c. In the above paragraph "a", since the motor operates in response to the musical rhythm, it is necessary to select a hydraulic motor which is capable of quickly reverting and strong enough to endure frequent changes in its operation. On the other hand, the musical control described in the above paragraph "b" causes musical rhythm to change in response to the mechanical movements of the bed and therefore, an electric motor with lower cost can be used.

In brief, the bed structure provided by the present invention is an electrically controllable novel bed suitable for use in family, hotels, entertainment places, hospitals, etc. The structure and function thereof may be modified to be simpler or more complicate to meet actual need of users.

What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. A multifunction bed structure comprising:

a main operation control unit including a bed head housing, a base, two upstanding side frames, a space defined by said bed head housing, said base, and said side frames, and an elevating mechanism;

said elevating mechanism including a controller disposed in said bed head housing, a motor, a gearbox, and a transmission shaft, an electromagnetic brake disposed in said base, two elevating heads separately disposed inside said two upstanding side frames and two driving mechanisms for moving the two elevating heads relative to the two upstanding side frames;

said motor being controlled by said controller to operate at different speed, displacement, and reverse pause time; said different speed, displacement, and reverse pause time of said motor being grouped into a plurality of different combinations, such that a user may cause said motor to operate via said controller in a manner selected from one or more groups of said combinations of different motor speed, displacement and reverse pause time; said manner of operation of said motor including an irregular operation in which more than one group of motor speed, displacement and reverse pause time combination is randomly selected to automatically repeat, a regular operation in which one group of motor speed, displacement and reverse pause time combination is selected to automatically repeat, and a manual operation in which said motor operates and stops at any time and in any group of speed, displacement and reverse pause time combination decided through manual control by a user; said transmission shaft being rotated by said motor via said gearbox to thereby drives said two driving mechanisms in said two upstanding side frames to move up and down, so that said two elevating heads connected to said two driving mechanisms are moved up and down in said two upstanding side frames; and a bed portion being connected at a head end to said main operational control unit via said two elevating heads, wherein said bed is a non-roller type, said non-roller type bed portion including a mattress divided into a movable back rest part, a fixed hip rest part, a movable thigh rest part, and a movable leg rest part, a bed frame supporting said mattress, a folding leg frame connected provided below said bed frame near the head end of said bed portion, a fixed leg frame connected to a rear end of said bed portion, and a mattress raising mechanism provided below said mattress and said bed frame to raise or lower a head end of said back rest part so that said back rest part is adjustably inclined at an angle relative to said bed frame, said raising mechanism also permitting a joint between said thigh rest part and said leg rest part to arch; both said folding and said fixed leg frames having casters mounted to a bottom end thereof, said bed portion with said folding leg frame in a folded position being allowed to slide forward or backward while said elevating heads are driven by said motor to move downward or upward, whereby when said elevating heads are driven by said motor to move up and down within a set displacement range, said bed frame and said mattress are brought by said elevating heads to move up and down and to move forward and backward in a regular or irregular manner, and when said raising mechanism and said lifting mechanism are driven by said controller to respectively raise said bed mattress parts and to lift said bed frame in different manners selected by a user, said bed mattress parts may be laid horizontally or inclinedly to meet actual need of the user.

2. The multifunction bed structure as claimed in claim 1, wherein said elevating mechanism of said main operational control unit is moved up and down between two points through three different controls including manual control, displacement range control, and random control.

3. The multifunction bed structure as claimed in claim 1, wherein said elevating mechanism of said main operational control unit is moved up and down to cause said non-roller bed portion to move up and down and to move backward and forward.

4. The multifunction bed structure of claim 1, wherein the drive mechanism comprises: an endless chain located in each of the two upstanding side frames, each endless chain connected to one of said two elevating heads; and a counterweight connected to each of said endless chains.

5. The multifunction bed structure of claim 4 further comprising a linear guide rail to slidably guide each of the two elevating heads.

6. The multifunction bed structure of claim 4 further comprising a linear guide rod to slidably guide each of said two elevating heads.

7. The multifunction bed structure of claim 1, wherein said motor comprises an electric motor.

8. The multifunction bed structure of claim 1, wherein said motor comprises an hydraulic motor.

9. The multifunction bed structure of claim 1, wherein the drive mechanism comprises a threaded rod located in each of said two upstanding side frames and threadingly engaging one of said two elevating heads, each threaded rod being rotatably driven by said motor such that rotation of said threaded rods causes said two elevating heads to move up and down.

10. A multifunction bed structure comprising:

a main operation control unit including a bed head housing, two upstanding side frames, a space defined by said bed head housing, said base, and said side frames, and an elevating mechanism;

said elevating mechanism including a controller disposed in said bed head housing, a motor, a gearbox, and a transmission shaft, an electromagnetic brake disposed in said base, two elevating heads separately disposed inside said two upstanding side frames and two driving mechanisms for moving the two elevating heads relative to the two upstanding side frames;

said motor being controlled by said controller to operate at different speed, displacement, and reverse pause time; said different speed, displacement, and reverse pause time of said motor being grouped into a plurality of different combinations, such that a user may cause said motor to operate via said controller in a manner selected from one or more groups of said combinations of different motor speed, displacement and reverse pause time; said manner of operation of said motor including an irregular operation in which more than one group of motor speed, displacement and reverse pause time combination is randomly selected to automatically repeat, a regular operation in which one group of motor speed, displacement and reverse pause time combination is selected to automatically repeat, and a manual operation in which said motor operates and stops at any time and in any group of speed, displacement and reverse pause time combination decided through manual control by a user; said transmission shaft being rotated by said motor via said gearbox to thereby drive said two driving mechanisms in said two upstanding side frames to move up and down, so that said two elevating heads connected to said two driving mechanisms are moved up and down in said two upstanding side frames; and a bed portion being connected at a head end to said main operational control unit via said two elevating heads, wherein said bed is a roller type, said roller type bed portion including a mattress divided into a movable back rest part, a fixed hip rest part, a movable thigh rest part, and a movable leg rest part, a bed frame supporting said mattress and having a head end connected to said elevating heads of said main operational control unit, a chassis structure including two side beams firmly locked to a base of said main operational control unit, a raising mechanism connected to and located below said bed frame, and a lifting mechanism connected to rear ends of said side beams for adjusting an inclined angle of said bed frame relative to said bed head housing of said main operational control unit; said bed frame being movably located above said chassis structure and being provided along its two side members with two roller channels, two rollers connected to two ends of a roller shaft being separately set in said roller channels to slide therein; said lifting mechanism further including an extensible rod, a return spring, two side supporting arms, and a transverse shaft; said extensible rod being mounted so that two ends thereof are pivotally turnable, side supporting arms being separately connected at their upper ends to two outer ends of said roller shaft; whereby when said extensible rod is driven to push or pull said transverse shaft connected to and extending between lower portions of said two side supporting arms, said roller shaft and said rollers are caused to slide along said roller channels on said side members of said bed frame and to thereby pivotally lift or lower a rear end of said bed frame relative to said chassis structure; and a plurality of casters being provided to a bottom of said chassis structure for convenient moving of said bed structure;

whereby when said elevating heads are driven by said motor to move up and down within a set displacement range, said bed frame and said mattress are caused by said elevating heads to move up and down and to move forward and backward in a regular or irregular manner, and when said raising mechanism and said lifting mechanism are driven by said controller to respectively raise said bed mattress parts and to lift said bed frame in different manners selected by a user, said bed mattress parts may be laid horizontally or inclinedly to meet actual need of the user.

11. The multifunction bed structure as claimed in claim 10, wherein said elevating mechanism of said main operational control unit is moved up and down between two points through three different controls including manual control, displacement range control, and random control.

12. The multifunction bed structure as claimed in claim 10, wherein said elevating mechanism of said main operational control unit is moved up and down to cause said roller bed portion to move up and down and to move backward and forward.

13. The multifunction bed structure of claim 10, wherein the drive mechanism comprises: an endless chain located in each of the two upstanding side frames, each endless chain connected to one of said two elevating heads; and a counterweight connected to each of said endless chains.

14. The multifunction bed structure of claim 13 further comprising a linear guide rail to slidably guide each of the two elevating heads.

15. The multifunction bed structure of claim 13 further comprising a linear guide rod to slidably guide each of said two elevating heads.

16. The multifunction bed structure of claim 10, wherein said motor comprises an electric motor.

17. The multifunction bed structure of claim 10, wherein said motor comprises an hydraulic motor.

18. The multifunction bed structure of claim 10, wherein the drive mechanism comprises a threaded rod located in each of said two upstanding side frames and threadingly engaging one of said two elevating heads, each threaded rod being rotatably driven by said motor such that rotation of said threaded rods causes said two elevating heads to move up and down.

* * * * *